US006641466B2

(12) United States Patent
Wallendorf et al.

(10) Patent No.: US 6,641,466 B2
(45) Date of Patent: Nov. 4, 2003

(54) APPARATUS FOR SECURING AND CLAMPING OPTICAL LENSES REQUIRING EDGE-MACHINING, IN PARTICULAR SPECTACLE LENSES

(75) Inventors: Steffen Wallendorf, Giessen-Kleinlinden (DE); Holger Schäfer, Weilmünster (DE)

(73) Assignee: Optikmaschinen AG (DE)

( * ) Notice: Subject to any disclaimer, the term of this patent is extended or adjusted under 35 U.S.C. 154(b) by 0 days.

(21) Appl. No.: 10/103,529

(22) Filed: Mar. 21, 2002

(65) Prior Publication Data

US 2002/0149862 A1 Oct. 17, 2002

(30) Foreign Application Priority Data

Mar. 22, 2001 (DE) ..... 101 14 238

(51) Int. Cl.[7] ..... B24B 9/14

(52) U.S. Cl. ..... 451/285; 451/43; 451/255; 451/285; 451/365; 451/390

(58) Field of Search ..... 451/42–44, 255, 451/256, 285, 364, 365, 367, 384, 385, 390, 460

(56) References Cited

U.S. PATENT DOCUMENTS 3,631,637 A * 1/1972 Tagnon ..... 451/390
3,745,720 A * 7/1973 Savage ..... 451/239
3,962,833 A * 6/1976 Johnson ..... 451/42
4,118,898 A * 10/1978 Godot ..... 451/390
4,158,273 A * 6/1979 Olsen et al. ..... 451/42
5,291,692 A * 3/1994 Takahashi et al. ..... 451/388
5,408,792 A * 4/1995 Gottschald ..... 451/65
5,454,748 A * 10/1995 Gottschald ..... 451/41
6,045,438 A * 4/2000 Shay ..... 451/384
6,074,290 A * 6/2000 Ko et al. ..... 451/390

FOREIGN PATENT DOCUMENTS

DE WO 00/03838 * 1/2000 ..... B24B/9/14

OTHER PUBLICATIONS

DE 3809565 C1, Wernicke & Co GmbH, Spectacle lens edge–grinding machine with two half–shafts holding the spectacle lens between them, (Feb. 23, 1989), Bundesrepublik Patentschrift, see english translation of Abstract.*

* cited by examiner

*Primary Examiner*—Joseph J. Hail, III
*Assistant Examiner*—David B. Thomas
(74) *Attorney, Agent, or Firm*—McAndrews, Held & Malloy, Ltd.

(57) ABSTRACT

An apparatus is provided for securing and clamping optical lenses requiring edge-machining, in particular spectacle lenses, which exhibits improved handling and which is optimised from the point of view of virtually backlash-free rotary drive of the optical lens. Elements located between two holding shafts, in particular a clamping assembly, a securing member with securing member adapter and an adhesive connection between securing member and optical lens are specially designed for this purpose.

34 Claims, 4 Drawing Sheets

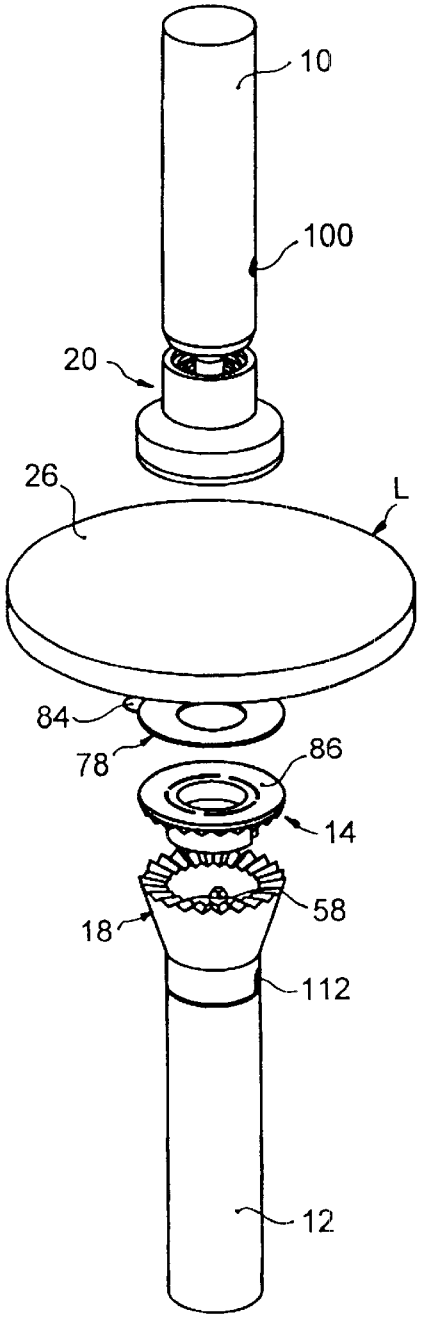
FIG. 1
FIG. 2
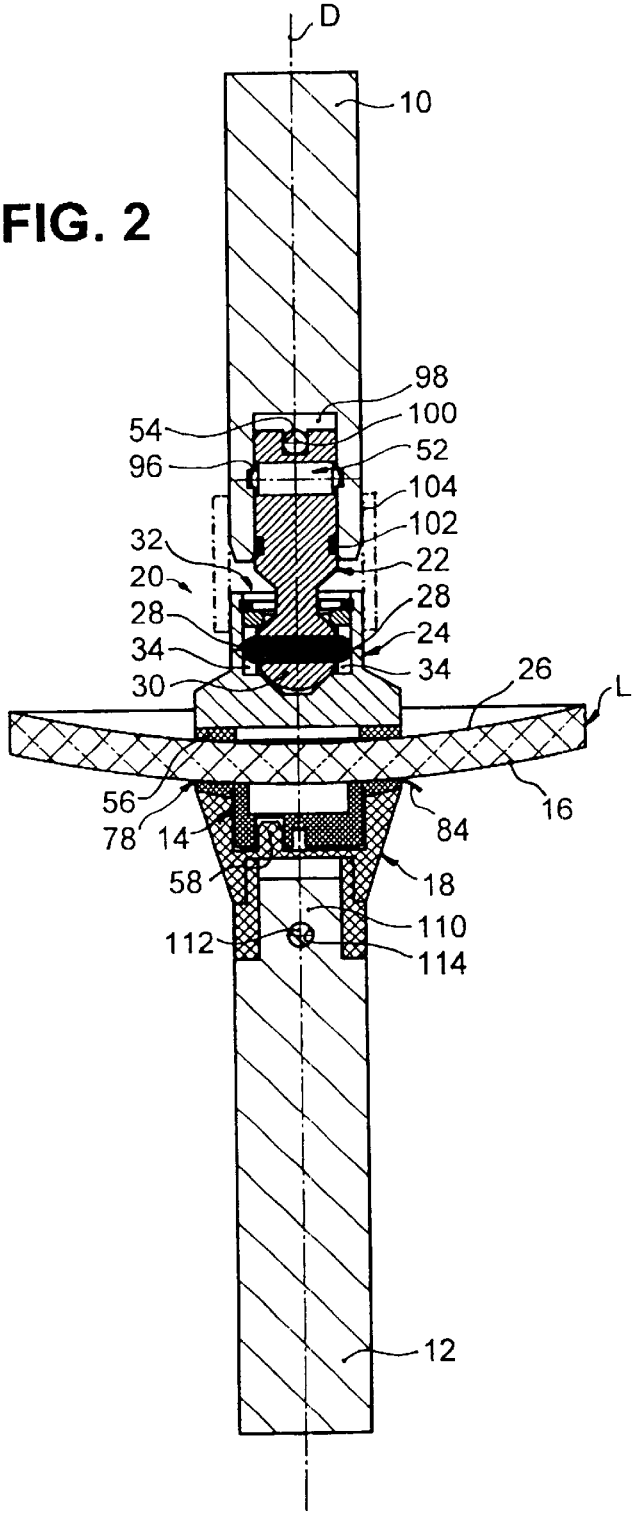

FIG. 4
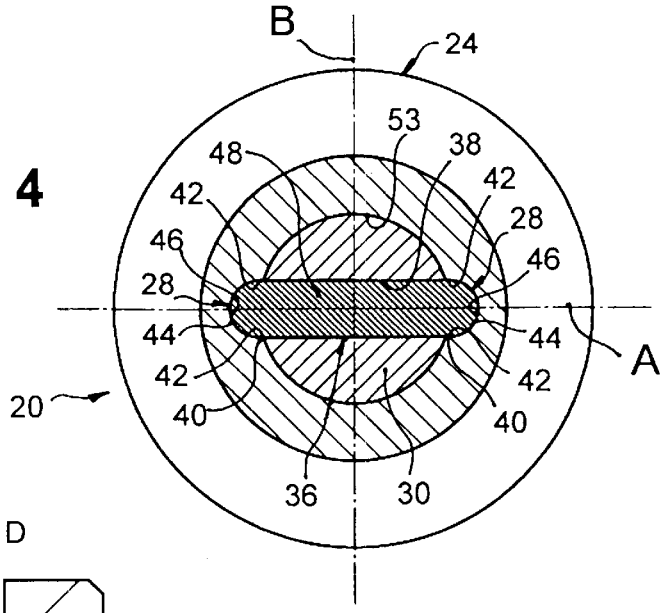
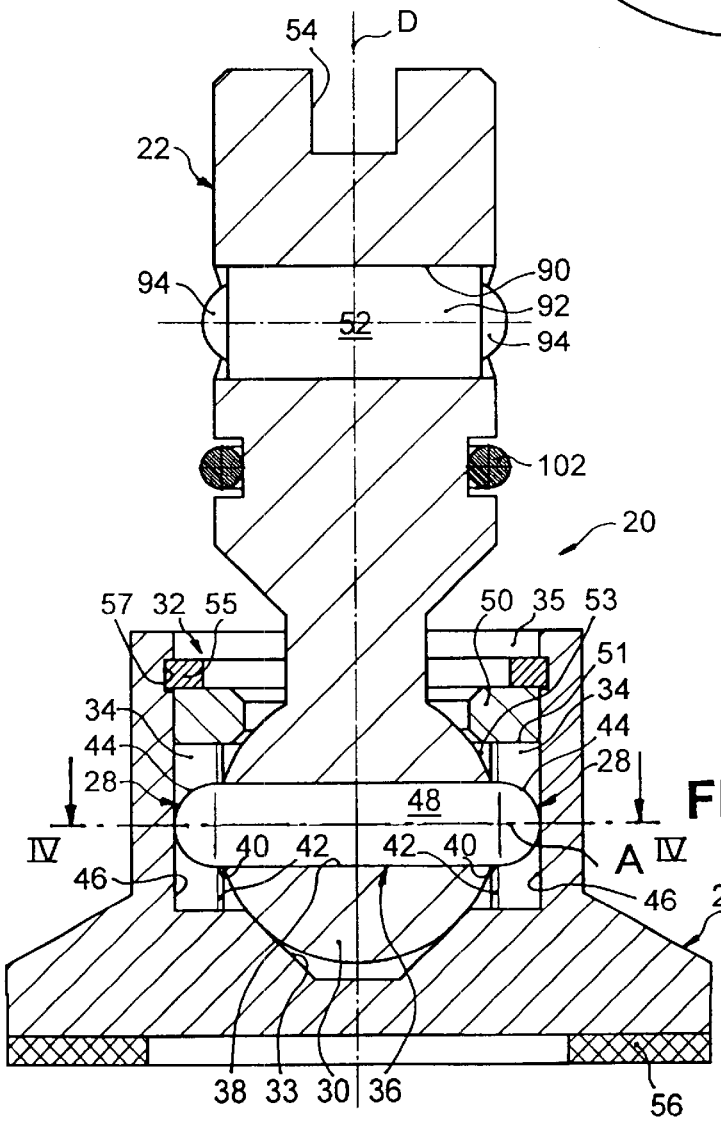
FIG. 3

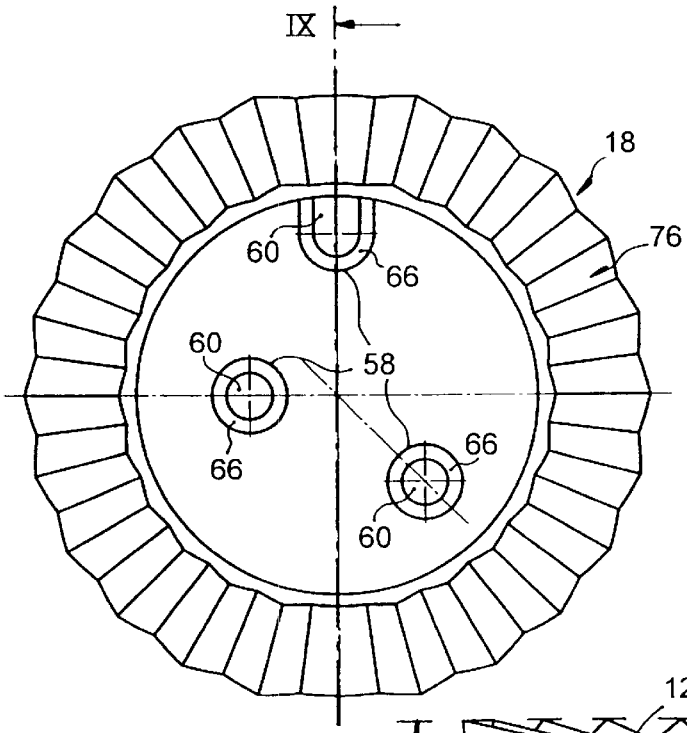
FIG. 8
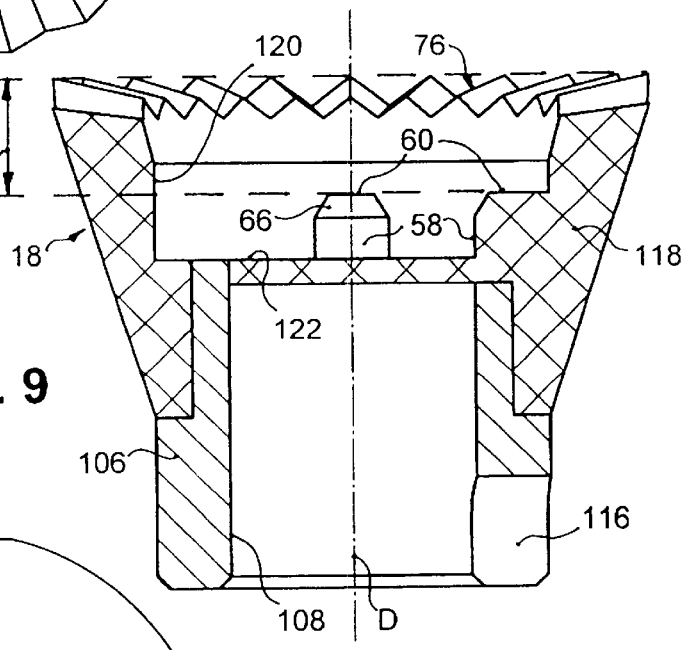
FIG. 9
FIG. 10
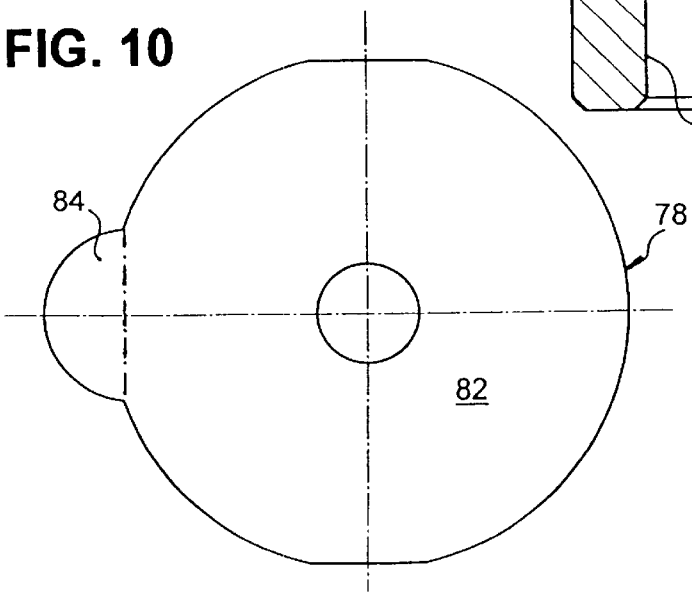
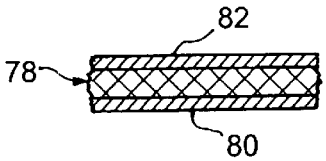
FIG. 11

APPARATUS FOR SECURING AND CLAMPING OPTICAL LENSES REQUIRING EDGE-MACHINING, IN PARTICULAR SPECTACLE LENSES

BACKGROUND OF THE INVENTION

The invention relates to an apparatus for securing and clamping optical lenses requiring edge-machining, in particular spectacle lenses.

Where the term spectacle lenses is used below, it should be understood to mean optical lenses or lens blanks for spectacles made of the usual materials, such as polycarbonate, inorganic glass, CR-39, HI-Index etc., and with circumferential edges of any shape, which lenses or lens blanks may be, but do not have to be, machined on one or both optically effective surfaces prior to machining of the edge thereof.

DESCRIPTION OF THE PRIOR ART

In the field of spectacle lens edge-machining, the purpose of which is to finish the edge of a spectacle lens in such a way that the spectacle lens may be inserted into a spectacle frame, various arrangements or systems are known which serve to mount the spectacle lens for edge-machining and to clamp it between rotatable holding shafts of a spectacle lens edge-machining machine, which shafts are adjustable in the axial direction relative to one another.

These systems accordingly comprise at least the following components:

- a securing or blocking member, which may be attached detachably to one side of the spectacle lens, (see for example EP-A-0 235 543: FIGS. 4 and 5; EP-A-0 839 603: FIGS. 1 and 2);
- an adapter for the securing or blocking member, which may be connected rigidly to one of the holding shafts of the spectacle lens edge-machining machine and is constructed for rotation angle-oriented rotary drive of the securing or blocking member (see for example EP-A-0 235 543: FIGS. 1 to 3; EP-A-0 839 603: FIG. 5); and
- a clamping assembly, which comprises a fastening portion, connectable rigidly to the other holding shaft of the spectacle lens edge-machining machine, and a clamping portion connected to the fastening portion, which clamping portion is constructed for force-locking engagement with the other side of the spectacle lens (see for example EP-A-0 995 546).

With respect to further known designs of the securing or blocking member and the adapter for the securing or blocking member reference is made to the leaflet "WECO Block-up System. D 704. Wernicke & Co. GmbH, Düsseldorf, Germany, March 1990" and to document DE-A-198 31 305. Further, it is known in the prior art to attach the securing member to the optical lens by means of an adhesive film portion or pad which is adhesive on both sides (see for example DE-U-92 00 513). Finally, another known design of the clamping assembly is shown in document DE-A-25 06 866.

Taking as a basis the prior art according for example to EP-A-0 235 543, an object of the invention is to provide an apparatus for securing and clamping optical lenses, in particular spectacle lenses, which is improved with regard to handling relative to the previously known solutions and which is optimised also from the point of view of the rotary drive of the optical lens, which is as free from backlash as possible.

SUMMARY OF THE INVENTION

According to one aspect of the present invention, there is provided an apparatus for securing and clamping optical lenses requiring edge-machining, between first and second rotatable holding shafts, having

- a securing member, which may be attached detachably to one side of the optical lens,
- an adapter for the securing member, which may be connected rigidly to said first holding shaft and is constructed for rotation angle-oriented rotary drive of the securing member, and
- a clamping assembly, which comprises a fastening portion connectable rigidly to said second holding shaft and a clamping portion connected to the fastening portion, which clamping portion is constructed for force-locking engagement with a second side of the optical lens,
- wherein the clamping assembly has a spherical head with opposing sides and an axis of rotation, which spherical head is provided on each of its opposing sides with a projection having an end zone, and which spherical head is accommodated in a receiving portion with opposing sides and an axis of rotation, which receiving portion is provided on its opposing sides with channels or grooves extending parallel to the axis of rotation of the receiving portion, which channels each have a channel bottom and serve for substantially rotary play-free guidance of the projections, for which the channel bottom of each of the channels displays, in cross section, a shape complementary to the end zone of the associated projection, wherein the clamping portion may be swivelled relative to the fastening portion about a first tilt axis perpendicular to the axis of rotation of the spherical head and extending through the projections, and about a second tilt axis perpendicular to the axis of rotation of the spherical head and to the first tilt axis, while torque may be transmitted via the projections from the fastening portion to the clamping portion.

According to a second aspect of the present invention, there is provided an apparatus for securing and clamping optical lenses requiring edge-machining, between first and second rotatable holding shafts, having

- a securing member, which may be attached detachably to one side of the optical lens,
- an adapter for the securing member, which may be connected rigidly to said first holding shaft and is constructed for rotation angle-oriented rotary drive of the securing member, and
- a clamping assembly, which comprises a fastening portion connectable rigidly to said second holding shaft and a clamping portion connected to the fastening portion, which clamping portion is constructed for force-locking engagement with a second other side of the optical lens, and
- wherein the securing member and the securing member adapter each comprise rotary drive elements for form-fitting rotary drive of the securing member by the securing member adapter, and positioning elements for orientation with regard to angle of rotation of the securing member relative to the securing member adapter,
- wherein the positioning elements on the securing member optionally on the securing member adapter take the form of a plurality of asymmetrically arranged projections with end faces, the end faces of which asymmetrically arranged projections lie in a common plane perpendicular to the axis of rotation, while the positioning elements on the securing member adapter optionally on the securing member take the form of recesses associated in complementary manner with the asymmetrically arranged projections, said recesses starting from a flat surface perpendicular to the axis of rotation, and wherein the axial distance between the rotary drive elements and the positioning elements on the securing member is different from an axial distance between the rotary drive elements and the positioning elements on the securing member adapter, such that, if the securing member is moved axially towards the securing member adapter and rotation angle orientation has not yet been achieved, first of all the projections come to rest against the flat surface and then, once rotation angle orientation is complete, the projections enter into the recesses, whereupon the rotary drive elements come into engagement with one another.

According to a third aspect of the present invention, there is provided an apparatus for securing and clamping optical lenses requiring edge-machining, between first and second rotatable holding shafts, having a securing member, which may be attached detachably to one side of the optical lens, an adapter for the securing member, which may be connected rigidly to said first holding shaft and is constructed for rotation angle-oriented rotary drive of the securing member, and a clamping assembly, which comprises a fastening portion connectable rigidly to said second holding shaft and a clamping portion connected to the fastening portion, which clamping portion is constructed for force-locking engagement with a second side of the optical lens, wherein the securing member is attachable to the optical lens by means of an adhesive film portion having first and second sides with adhesive on both of said first and second sides of the adhesive film portion, which exhibits greater adhesive power on said first side thereof that faces the securing member than on said second side thereof that faces the optical lens.

Constructing the clamping assembly according to the invention allows very precise, backlash-free torque transmission together with very smooth angle adjustment. The spherical head mounted in the receiving portion thereof and having two projections allows movements superimposed in the manner of a cardan joint about two tilt axes with virtually backlash-free rotary drive by the associated holding shaft due to the engagement between the projections and the channels in the receiving portion. Since the channel bottom of each of the channels displays, in cross section, a shape complementary and dimensionally matching, respectively, to the end zone of the associated projection, form-fitting engagement is obtained between the projections and the channels when viewed with the channel in cross section and the pin in longitudinal section, which form-fitting engagement is advantageous for backlash-free rotary motion transmission between spherical head and receiving portion. The backlash-free torque transmission thus obtained with low wear and at the same time very smooth angle adjustment is an essential prerequisite for a highly precise edging of spectacle lenses with machinery suitable for industrial production.

Precisely aligned orientation relative to the first tilt axis of the two projections of the spherical head may be achieved by the introduction of a pin, protruding on both sides beyond the spherical head so as to form projections, into a through-hole which extends with its central axis through the centre of the sphere and encloses the pin in play-free manner.

By means of the cylindrical surface zones on the two projections, interacting with flat guide surfaces of the channels associated with these surface zones, it is ensured that, in the event of swivel movements about the second tilt axis, the substantially rotary play-free guidance of the projections in the channels is maintained.

In view of a smooth angle adjustment of the clamping portion it is further of advantage if the end zones of the projections provided on the spherical head take the form of a spherical cap.

A construction of the pin which is favourable from the point of view of manufacture provides, that the pin is of continuously cylindrical construction, with the exception of its spherical cap-shaped end zones, such that the above-mentioned cylindrical surface zones are fixed in their corresponding diameters by the pin diameter itself, which is identical thereto. The overall length of the pin may be fixed by the radial spacing of the channel bottoms, which is greater only by slight movement play than the pin length measured externally over the spherical cap-shaped ends of the pin.

The pin may be enclosed by the through-hole in the spherical head by interference fit, but it is preferably accommodated in the through-hole by sliding fit and this provides the advantage that, upon insertion of the pin into the through-hole, it does not have to be ensured that the axial projection dimensions correspond exactly and with low tolerance. Upon insertion of the spherical head into the receiving portion, the pin, which is axially displaceable in the through-hole of the spherical head, adjusts itself, as it were, automatically to the correct axial projection dimensions in accordance with the position of the channel bottoms.

Axial securing of the spherical head after its introduction into the receiving portion may be by means of a two-part retaining ring engaging behind the spherical head.

The spherical head may be associated with the fastening portion of the clamping assembly, while the receiving portion may be associated with the clamping portion of the clamping assembly. Detachable fastening of the clamping assembly to the relevant holding shaft may proceed by means of a locking means on the fastening portion. Rotary drive by this holding shaft can be effected, by a channel formed in the end of the fastening portion, in which channel a cross-pin borne by the holding shaft engages non-rotatably and without play.

The clamping portion can comprise a covering for force-locking engagement with the optical lens, which covering consists of a material which is comparatively softer than the lens, to prevent damage to the lens surface during lens loading, edge-machining and lens removal.

Continuing the concept behind the invention, the arrangement for securing optical lenses comprises a securing member and a securing member adapter, which, are especially constructed on the one hand for form-fitting rotary drive of the securing member by the securing member adapter and on the other hand for positioning, correct with regard to angle of rotation, of securing member and securing member adapter. To this end, both securing member and securing member adapter comprise on the one hand rotary drive elements and on the other hand positioning elements. The positioning elements take the form of a plurality of projections on one of the two components consisting of securing member and securing member adapter and of recesses complementary to the projections on the other of the two components. The arrangement is such that the end faces of the projections lie in a common imaginary plane perpendicular to the axis of rotation, while the recesses start from a flat surface plane-parallel to this common plane. Moreover, the axial distance between the rotary drive elements and the positioning elements on the securing member is different from the axial distance between these elements on the securing member adapter. Owing to this construction, when the securing member approaches the securing member adapter, which is thus not yet at the correct angle of rotation, first of all the end faces of the projections come to rest against the flat surface comprising the recesses, without the rotary drive elements as yet engaging with one another. If correct orientation with regard to angle of rotation is then achieved by rotating the securing member relative to the securing member adapter, wherein the end faces of the projections slide on the above-mentioned flat surface, the projections finally enter the recesses for fixing the relative position with regard to angle of rotation, provided that securing member and securing member adapter are axially aligned, until, as the securing member further approaches the securing member adapter, the rotary drive elements move into engagement with one another.

Three projections and consequently three recesses may be provided, wherein the projections or the end faces thereof and the recesses or the inlet openings thereof each form the corners of matching triangles. Due to this configuration, the securing member comes to lie in secure, tilt-free manner on the securing member adapter, without the rotary drive elements yet entering partially into undesired engagement. The projections hold the securing member at a distance from the securing member adapter until the correct relative position with regard to angle of rotation is reached. Then all the rotary drive elements move extensively into engagement.

To simplify insertion of the projections into the recesses, provision is made for the projections to comprise bezels or bevels starting from their end faces and/or the recesses to comprise bezels or bevels at their inlet openings starting from the flat surface.

Preferably, the projections are located on the securing member adapter and the recesses on the securing member.

According to another important aspect of the invention, the securing member may comprise a hub portion comprising the positioning elements and an outer annular portion connected resiliently therewith, which bears the rotary drive elements of the securing member. The resilient connection between the annular portion and the hub portion allows simplified, improved adaptation of the securing member to the convexity of the lens to be machined.

The above-mentioned resilient connection between hub portion and annular portion may be achieved by a plurality of webs or the like distributed evenly about the circumference. During injection-molding of the securing member from a suitable thermoplastic material, hub portion, webs and annular portions may be molded in one piece. Instead of individual webs, a circumferentially continuous, annular, thin-walled connection may also be provided between hub portion and annular portion, which connection allows similar flexible deformation between annular portion and hub portion for the purpose of adaptation to lens convexity.

The rotary drive elements on the securing member and on the securing member adapter are constructed, as complementary annular toothing or annular toothed portions. This annular toothing has the effect of centring a securing member and securing member adapter due to the radial tooth orientation thereof optionally together with a complementary conical construction of the annular toothing.

An especially-constructed adhesive film portion may be provided, with which the securing member and the optical lens may be connected together detachably but non-rotatably for the edge-machining operation. The two adhesive layers of the adhesive film portion, which is adhesive on both sides, exhibit different adhesive powers, such that the adhesive power on the side of the adhesive film portion facing the securing member is greater than on the lens side. In this way, when the lens is removed it is ensured that the adhesive film portion remains stuck detachably to the securing member and thus does not have to be removed from the lens surface, which could cause superficial damage to the lens or leave adhesive residues on the lens. To ensure easier removability of the adhesive film portion from the securing member, a tab projecting beyond the outer circumference of the securing member may be provided on the adhesive film portion, which tab is non-adhesive at least on its side facing the optical lens, in order to prevent adhesion to the lens.

The adhesive film portion of the arrangement may be extraordinarily thin in comparison to the prior art. For example, it has a thickness of between only approximately 0.025 and 0.2 mm, compared to a conventional thickness of approximately 0.5 to 0.8 mm. Due to this very small thickness, which is made possible due to the resilient deformability of the securing member as described, no deformation or flexing phenomena occur in the adhesive film portion due to the torsional forces at work.

BRIEF DESCRIPTION OF THE DRAWINGS

The invention will be described in more detail below in relation to a preferred exemplary embodiment and with reference to the attached, partially schematic drawings, in which:

FIG. 1 is a perspective exploded representation of An apparatus for securing and clamping a spectacle lens requiring edge-machining, which representation shows, from the bottom upwards, a securing member adapter mounted on a schematically illustrated lower holding shaft, a securing member, an adhesive film portion, the spectacle lens and a clamping assembly mounted on a schematically illustrated upper holding shaft, FIG. 2 is a sectional view of the arrangement shown in FIG. 1 in the functional position, FIG. 3 is a sectional view of the clamping assembly according to FIG. 2 on an enlarged scale relative to FIG. 2, FIG. 4 is a sectional view along the section line IV—IV of FIG. 3 on a reduced scale relative to FIG. 3, FIG. 8 is a plan view of the securing member adapter shown in FIG. 5 on a somewhat enlarged scale relative to FIG. 5, FIG. 9 is a sectional view of the securing member adapter along section line IX—IX of FIG. 8, rotated by 90° in the clockwise direction in the drawing plane, FIG. 10 is a plan view of the adhesive film portion according to FIG. 1 on an enlarged scale relative to FIG. 1 and FIG. 11 is a schematic, broken-away cross-sectional view of the adhesive film portion according to FIG. 10 on a very enlarged scale.

DESCRIPTION OF THE PREFERRED EMBODIMENTS

Figure 5:
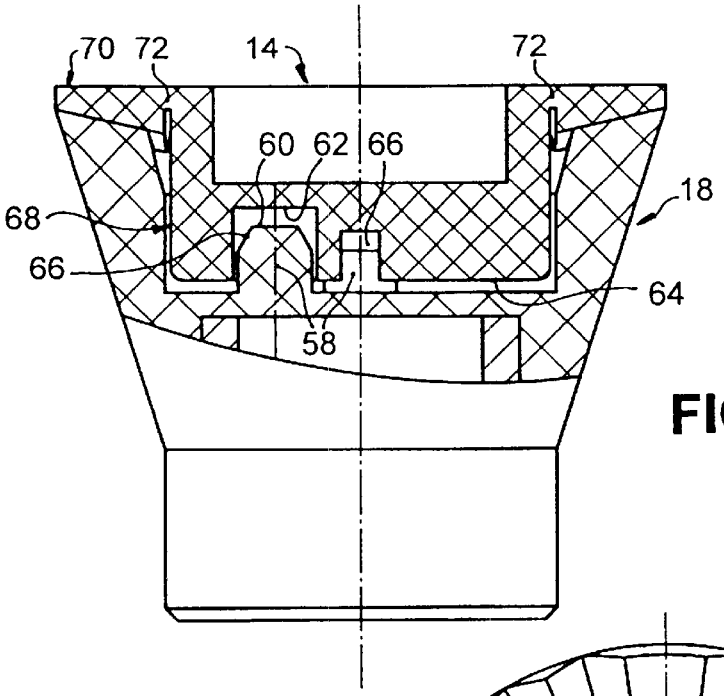
FIG. 5 is a broken-open side view of the securing member according to FIG. 2 mounted on the securing member adapter on an enlarged scale relative to FIG. 2.

As is revealed by FIGS. 1 and 2, two rotatably mounted holding shafts 10 and 12 (bearing system not shown) are provided in the preferred vertical functional and machining position on the arrangement for securing and clamping a spectacle lens L requiring edge-machining. Between the components and elements of and connected to said shafts 10 and 12, which components and elements have yet to be described in more detail, there is arranged the spectacle lens L. It must be ensured that the spectacle lens L clamped between the holding shafts 10 and 12 is reliably prevented from slipping during edge-machining. Such slippage must not occur for example under any circumstances if the spectacle lens to be machined comprises a close-focus portion aligned in angularly precise manner relative to the optical axis or a cylindrical or prismatic ground surface, the axial position of which must be in a predetermined relationship to the position of the spectacle lens mounted in the spectacle frame.

The lower holding shaft 12 is connected rigidly, non-rotatably and coaxially to a securing member adapter 18, which is constructed in a manner yet to be described for angle of rotation-oriented rotary drive of a securing member 14 fitted removably to the securing member adapter 18. The securing member 14 may be fixed detachably to one side 16 of the optical lens. A clamping assembly 20 is fitted coaxially on the upper holding shaft 10 and comprises a fastening portion 22 connectable rigidly to the holding shaft 10 and a clamping portion 24 connected therewith. The clamping portion 24 is constructed for force-locking engagement with the other side 26 of the optical lens L.

The clamping assembly 20, the details of which are revealed clearly in particular by FIGS. 3 and 4, has a spherical head 30 provided with a projection 28 on each of its opposing sides. Said spherical head 30 is accommodated in a receiving portion 32 and supported at the bottom on a truncated cone-shaped ball bearing surface 33. This may also take the form of a portion of a spherical surface. The receiving portion 32 is provided with channels 34 extending parallel to the axis of rotation D on opposing sides, which channels 34 serve for substantially rotary play-free guidance of the projections 28. The clamping portion 24 may be swivelled cardanically relative to the fastening portion 22 about a first tilt axis A perpendicular to the axis of rotation D of the spherical head 30 and extending coaxially through the projections 28 and about a second tilt axis B perpendicular to the axis of rotation of the spherical head 30 and to the first tilt axis A. The torque introduced via the holding shaft 10 is transmitted via the projections 28 from the fastening portion 22 to the clamping portion 24.

The projections 28 provided on the spherical head 30 are formed by a pin 36, which extends through a through-hole 38 in the spherical head 30. Each of the two projections 28 provided on the spherical head 30 comprises a cylindrical surface zone 40 protruding out of the through-hole 38. The channels 34 in the receiving portion 32 each have two opposing flat guide surfaces 42, which extend parallel to one another and serve for substantially play-free guidance of the cylindrical surface zones 40 of the projections 28. This guidance is not lost in the event of swivel movements about the second tilt axis B within expected swivel movement limits.

Each of the projections 28 provided on the spherical head 30 comprises an end zone 44, which takes the form of a spherical cap. As is clear from FIG. 4, the channel bottom 46 of each of the two channels 34 provided in the receiving portion 32, when viewed in cross section, displays a shape complementary to the spherical cap-shaped end zone 44 of the associated projection 28. The end zones 44 of the projections 28 have a sphere radius which is identical to the radius of the cross section of the pin 36, i.e. the end zones 44 adjoin the pin 36 continuously, including the cylindrical surface zones 40.

In contrast to the preferred construction shown, the channels 34 may also have a rectangular cross section, wherein the channel width is greater only by a small amount of movement play than the diameter of the cylindrical surface zones 40 of the projections 28. In this instance, the channel side walls form the guide surfaces 42. The sphere radii of the end zones 44 do not have to correspond to the radius of the cylindrical surface zones 40 or the radius of the cross section of the pin 36, but may be greater than these. It has merely to be ensured that the length of the pin 36, measured over the end zones, is smaller by an amount of movement play than the spacing of the channel bottoms of the rectangular channels. The sphere radius of the end zones 44 should however be smaller than half the pin length.

The pin 36 has a cylindrical basic member 48 forming the cylindrical surface zones 40 of the projections 28. Said basic member is provided at both sides with the spherical cap-shaped end zones 44. The pin 36 has a length which is smaller by an amount of movement play than the diametrally measured spacing of the channel bottoms 46. The pin 36 may be accommodated in the through-hole 38 in the spherical head 30 in axially displaceable manner.

The receiving portion 32 for the spherical head 30 is provided on the clamping portion 24 of the clamping assembly 20. As is clearest from FIG. 3, the spherical head 30 is held in the receiving portion 32 by means of a two-part retaining ring 50 engaging behind the spherical head 30. The two-part retaining ring rests on an annular shoulder 51, interrupted by the channels 34, of a stepped bore 35 in the receiving portion 32 enclosing the spherical head 30 in its lower area 53 tightly but with movement play (FIG. 4). The two-part retaining ring 50 is in turn held by a snap ring 55, which engages in an annular channel 57 in the stepped bore 35. In the arrangement shown, the spherical head 30 is a component of the fastening portion 22 and is thus in one piece.

The fastening portion 22 of the clamping assembly 20 comprises a locking means 52, by means of which the clamping assembly 20 may be locked detachably to the corresponding holding shaft 10 (FIGS. 2, 3). In the Example shown, the locking means 52 is a cylindrical sleeve 92 inserted perpendicularly into a bore 90 in the fastening portion 22, from which locking balls 94 project captively on both sides, which locking balls 94 are loaded divergently by a spring arrangement (not shown) within the cylindrical sleeve 92. The locking balls 94 project beyond the external circumference of the cylindrical fastening portion 22, such that they may be locked together with a locking channel 96 inside a blind bore 98 in the holding shaft 10 accommodating the fastening portion 22 (FIG. 2).

The fastening portion 22 of the clamping assembly 20 is provided at the end with a channel 54, into which a cross-pin 100 engages for form-fitting rotary drive by the holding shaft 10, which cross-pin 100 is introduced into a transverse bore in the holding shaft 10. This transverse bore passes through diametrically opposing wall areas of the holding shaft 10 defining the blind bore 98. Rotation of the holding shaft 10 is thus transmitted via the cross-pin 100 to the fastening portion 22 and thence via engagement of the projections 28 with the channels 34 to the clamping portion 24.

The clamping portion 24 comprises a covering 56 for force-locking engagement with the optical lens L, which covering 56 is in the shape of a circular ring in the Example shown. It consists of a material, such as leather or synthetic leather, which is soft in relation to the material of the optical lens L. The covering may be connected with the lower surface of the clamping portion 24 by adhesion. If an injection-moldable polymeric material is used for the covering 56, the latter may also be constructed on its upper side with projections or the like for form-fitting engagement with corresponding recesses or the like in the lower surface of the clamping portion 24 (not shown). It is essential for the covering to comprise good adhesive power relative to the optical lens for torque transmission and for the covering not to be capable of causing any damage to the lens surface or thin layers attached thereto, such as anti-reflection coatings.

A groove ring seal 102 in the form of an O-ring ensures a seal between the fastening portion 22 and the holding shaft 10. It seals these elements off from one another in the lower area of the blind bore 98. As is indicated by dash-dotted lines in FIG. 2, the holding shaft 10 and the clamping portion 24 may be connected together by a tubular or hose-shaped flexible collar 104. Due to its flexibility, this collar does not prevent cardanic movements of the clamping portion 24 relative to the holding shaft 10, but does seal the receiving portion 32 effectively against the penetration of contaminants such as grinding dust. In addition, the collar 104 has the tendency, especially if it consists of rubber or an elastomeric plastics material, to adopt its extended hollow-cylindrical position, whereby it exerts a precentring action on the clamping portion 24 prior to engagement with the optical lens L.

For a more detailed explanation of the securing member 14, the securing member adapter 18 and their mutual association together with their connection with the lower holding shaft 12, reference is now made to FIGS. 1 and 2 in conjunction with FIGS. 5 to 9.

For form-fitting rotary drive of the securing member 14 by the securing adapter 18, these components each comprise rotary drive elements, toothed in the Example, which will be described in more detail below. Furthermore, securing member 14 and securing member adapter 18 likewise each comprise positioning elements, described in more detail below, which have the task of orienting or positioning securing member 14 and securing member adapter 18 correctly relative to one another with regard to angle of rotation prior to engagement of the rotary drive elements.

The positioning elements consist of a plurality of asymmetrically arranged projections 58 and a plurality of complementarily associated, correspondingly asymmetrically arranged recesses 62. The projections 58 may either be arranged on the securing member 14 or on the securing member adapter 18. The same is true of the recesses 62, i.e. if the projections 58 are located on the securing member 14, the recesses 62 are arranged on the securing member adapter 18. If, on the other hand, the projections 58 are arranged on the securing member adapter 18, the recesses 62 are arranged on the securing member 14. Preferably, and as illustrated, the projections 58 are constructed on the securing member adapter 18, while the recesses 62 are provided on the securing member 14.

Figure 6:
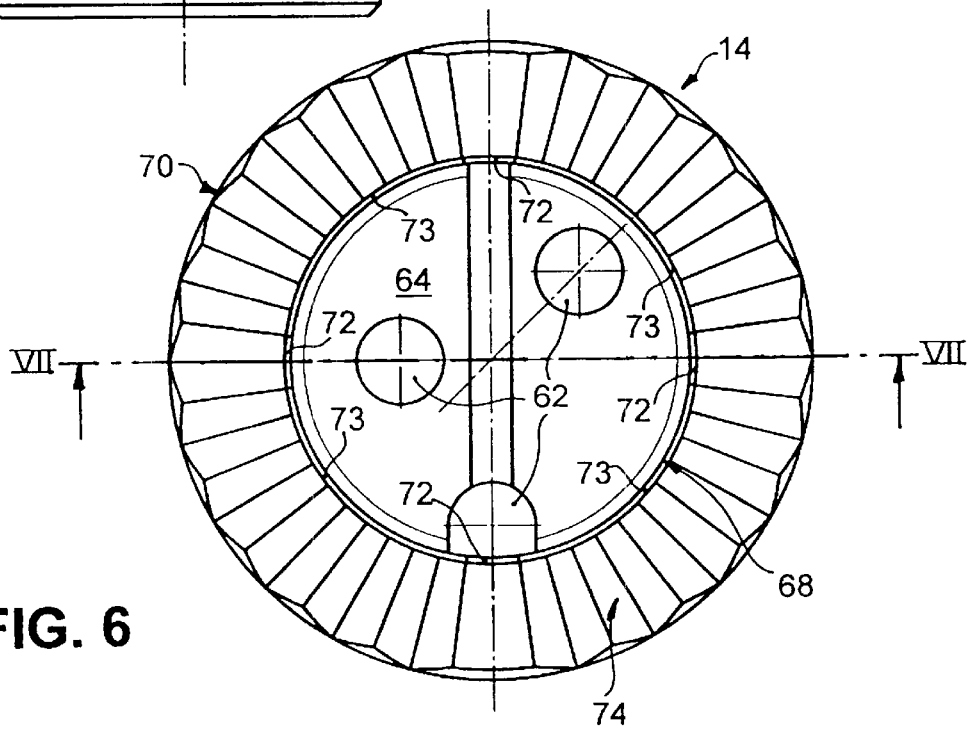
FIG. 6 is a view from below of the securing member shown in FIG. 5 on a somewhat enlarged scale relative to FIG. 5.
Figure 7:
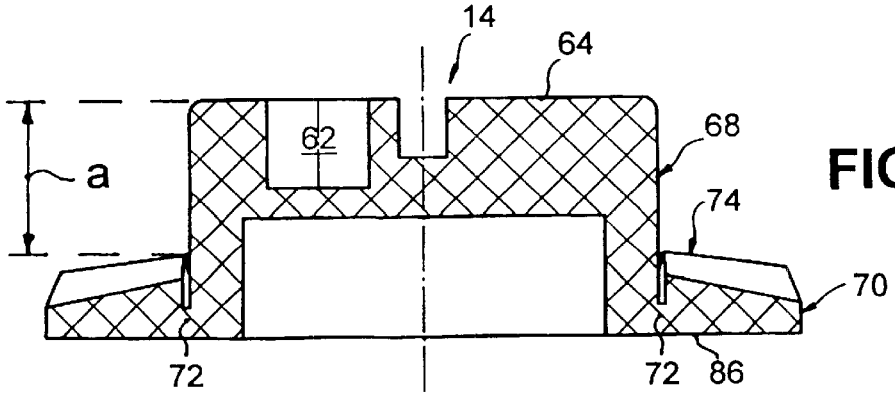
FIG. 7 is a sectional view of the securing member along section line VII—VII in FIG. 6 on a somewhat enlarged scale relative to FIG. 6.

The end faces 60 of the projections 58 lie in a common plane perpendicular to the axis of rotation D (FIGS. 8, 9). The recesses 62 start from a flat surface 64 perpendicular to the axis of rotation D (FIGS. 5, 6, 7). The arrangement is such that, at the securing member 14, the axial distance a (FIG. 7) between the rotary drive elements and the positioning elements, i.e. the flat surface 64 from which the recesses start, is different from, i.e. greater than, the axial distance b (FIG. 9) on the securing member adapter 18 between the rotary drive elements and the positioning elements, i.e. the common plane of the end faces 60 of the projections 58.

This being so, the securing member 14 may be united in the manner indicated below with the securing member adapter 18 to yield the desired angularly correct engagement situation illustrated in FIG. 5. If the securing member 14 is moved axially towards the securing member adapter 18 and orientation with regard to angle of rotation of securing member and securing member adapter has not yet been achieved, first of all the projections 58 come to rest with their end faces 60 against the flat surface 64. Then, to effect the sole correct orientation with regard to angle of rotation, the securing member 14 is turned relative to the securing member adapter 18, wherein the end faces 60 slide on the flat surface 64 without the securing member 14 effecting a tilting movement relative to the securing member adapter 18, which tilting movement could undesirably bring the rotary drive elements partially into engagement. Due to the matching asymmetrical arrangement of the projections 28 and the recesses 62, only one correct rotation angle orientation is possible. If the correct relative rotation angle orientation is achieved between securing member 14 and securing member adapter 18, the projections 58 enter the recesses 62 when moved axially closer together, whereupon the rotary drive elements, which are toothed on both sides, finally move into engagement with one another, as shown in FIG. 5, such that torque may be transmitted from the holding shaft 12 to the securing member 14. Moreover, with such arrangements, the two holding shafts 10 and 12 are driven synchronously at the same speed of rotation.

To ensure that the end faces 60 lie temporarily in tilt-safe manner against the flat surface 64, the three projections 58 provided in the exemplary embodiment and naturally also the recesses 62 form the corners of a triangle. However, it must be ensured that the triangle is not equilateral, with the corners thereof at the same radial distance from the axis of rotation, because three different engagement positions displaced by 120° relative to one another would then be possible. The projections and the recesses should be arranged asymmetrically with different radial distances from the axis of rotation.

To simplify introduction of the projections 58 into the recesses 62, the projections 58 and/or the recesses 62 exhibit bezels starting respectively from the end faces 60 of the former or the flat surface 64. Bezels at the inlet openings of the recesses 62 are not shown in the drawings.

As is clearest in FIG. 7, the securing member 14 has a hub portion 60, on which the positioning elements are provided, i.e. the recesses 62 starting from the flat surface.

Connected resiliently with the hub portion 68 is an annular portion 70 concentric thereto, which bears the toothed rotary drive elements. The resilient connection between the hub portion 68 and the annular portion 70 is provided in the Example shown (FIG. 6) by four webs 72 distributed evenly around the circumference, which are connected in one piece both with the annular portion 70 and with the hub portion 68. This one-piece nature is easily achieved if the securing member 14 is injection-molded altogether from a flexible PU-based thermoplastic (e.g. Elastollan). Instead of the webs 72, however, a thin-walled resilient circumferential connecting wall may also be provided between the hub portion 68 and the annular portion 70 (not shown). This then takes the place of the gaps 73 present between the webs 72.

As is clear in particular from FIGS. 6, 7 and 8, 9, the rotary drive elements are formed on the securing portion 14 and the securing portion adapter 18 by complementary annular toothing 74 or 76. This annular toothing 74 and 76 is slightly conical, being convexly conical on the securing member 14 and concavely conical on the securing member adapter 18. In this way, the annular toothing 74 and 76 has a centring effect upon engagement with regard to the common axis of securing member 14 and securing member adapter 18.

The securing member adapter 18 has a sleeve-shaped rotationally symmetrical member 106 made of metal, e.g. brass, which is provided with a central receiving bore 108 for the shaft end 110 (FIG. 2), of appropriately conformed diameter, of the holding shaft 12. Non-rotatable connection, correct with regard to angle of rotation, of the member 106 with the shaft end 110 is effected by a cross-pin 112, which engages in a transverse bore 114 in the shaft end 110 and at the same time in a drive recess 116 in the member 106. The drive recess 116 is so tightly adapted to the cross-pin 112 that the member 106 cannot rotate relative to the holding shaft 12 after fitting of the cross-pin 112. Only one drive recess 116 is provided, such that the securing member adapter 18 may be fitted to the holding shaft in only one position with regard to angle of rotation.

Attached to, for example injection-molded onto, the member 106, is an externally conical receiving element 118 for the securing member 14. The receiving element 118 is molded from a hard thermoplastic, for example polyoxymethylene (POM), and has a cylindrical receiving bore 120 for the hub portion 68 of the securing member 14. The upper edge of the receiving element 118 is shaped to form the annular toothing 76. The receiving bore 120 ends at an inner surface 122 oriented perpendicularly to the axis of rotation D, from which surface 122 there protrude the projections 58.

The securing member 14 may be attached to the optical lens L by means of an adhesive film portion 78 adhesive on both sides. The adhesive film portion 78 serves in mounting the lens L by means of the securing member 14 and is located after mounting and clamping between the securing member 14 and the lens L, as is clear from FIGS. 1 and 2. The special feature of the adhesive film portion 78 consists in the fact that the adhesive applied to the side 80 thereof facing the securing member 14 has a greater adhesive power than the adhesive applied to the side 82 thereof facing the lens L (FIG. 11), whereby stronger adhesion to the optical lens L, which would be undesirable, is prevented.

The adhesive film portion 78 shown in FIG. 10, which has an approximately circular external contour with a diameter corresponding approximately to the external diameter of the annular portion 70 of the securing member 14, is provided with a tab 84 which simplifies the removal thereof and is non-adhesive at least on the side thereof facing the lens L, such that it cannot stick to the lens L.

Due to the resilience of the bearing surface 86 facing the lens L (FIGS. 1, 7) of the securing member 14, the adhesive film portion 78 may exhibit a very small thickness of between approximately 0.025 and 0.2 mm, because the adhesive film portion does not have to perform any tasks in relation to adaptation to the for instance convex surface of the lens L due to the above-mentioned resilience of the securing member 14. The transmitted torque cannot deform or flex the very thin adhesive film portion.

In summary, an apparatus is proposed for securing and clamping lenses requiring edge-machining, in particular spectacle lenses, which exhibits improved handling and which is optimised from the point of view of virtually backlash-free rotary drive of the optical lens. The elements arranged between the two holding shafts, in particular the clamping assembly, the securing member with securing member adapter and the adhesive connection between securing member and optical lens are specially designed for this purpose.

We claim:

1. An apparatus for securing and clamping optical lenses requiring edge-machining, between first and second rotatable holding shafts, having a securing member, which may be attached detachably to one side of the optical lens, an adapter for the securing member, which may be connected rigidly to said first holding shaft and is constructed for rotation angle-oriented rotary drive of the securing member, and a clamping assembly, which comprises a fastening portion connectable rigidly to said second holding shaft and a clamping portion connected to the fastening portion, which clamping portion is constructed for force-locking engagement with a second side of the optical lens, wherein the clamping assembly has a spherical head with opposing sides and an axis of rotation, which spherical head is provided on each of its opposing sides with a projection having an end zone, and which spherical head is accommodated in a receiving portion with opposing sides and an axis of rotation, which receiving portion is provided on its opposing sides with channels extending parallel to the axis of rotation of the receiving portion, which channels each have a channel bottom and serve for substantially rotary play-free guidance of the projections, for which the channel bottom of each of the channels displays, in cross section, a shape complementary to the end zone of the associated projection, wherein the clamping portion may be swivelled relative to the fastening portion about a first tilt axis perpendicular to the axis of rotation of the spherical head and extending through the projections, and about a second tilt axis perpendicular to the axis of rotation of the spherical head and to the first tilt axis, while torque may be transmitted via the projections from the fastening portion to the clamping portion.

2. An apparatus according to claim 1, wherein the optical lens is a spectacle lens.

3. An apparatus according to claim 1, wherein the projections provided on the spherical head are formed by a pin which extends through a through-hole in the spherical head.

4. An apparatus according to claim 1, wherein each projection provided on the spherical head comprises a cylindrical surface zone.

5. An apparatus according to claim 4, wherein the channels in the receiving portion each comprise two flat guide surfaces, which guide surfaces extend parallel to one another and serve in substantially play-free guidance of the cylindrical surface zones of the projections provided on the spherical head.

6. An apparatus according to claim 1, wherein the end zones of the projections provided on the spherical head take the form of a spherical cap.

7. An apparatus according to claim 6, wherein the projections provided on the spherical head are formed by a pin which extends through a through-hole in the spherical head, wherein each projection provided on the spherical head comprises a cylindrical surface zone, wherein the channels in the receiving portion each comprise two flat guide surfaces, which guide surfaces extend parallel to one another and serve in substantially play-free guidance of the cylindrical surface zones of the projections provided on the spherical head and wherein the pin has a cylindrical basic member forming the cylindrical surface zones of the projections, which basic member has two sides that are both provided with the spherical cap-shaped end zones.

8. An apparatus according to claim 3, wherein the pin exhibits a length which corresponds substantially to the spacing of the channel bottoms.

9. An apparatus according to claim 3, wherein the pin is accommodated in axially displaceable manner in the through-hole in the spherical head.

10. An apparatus according to claim 1, wherein the spherical head is held in the receiving portion by means of a two-part retaining ring engaging behind the spherical head.

11. An apparatus according to claim 1, wherein the spherical head is a component of the fastening portion of the clamping assembly, while the receiving portion for the spherical head is provided on the clamping portion of the clamping assembly.

12. An apparatus according to claim 1, wherein the fastening portion of the clamping assembly comprises a locking means, by means of which the clamping assembly may be locked detachably together with the corresponding holding shaft.

13. An apparatus according to claim 1, wherein the fastening portion of the clamping assembly is provided at the end with a channel for form-fitting rotary drive by the corresponding holding shaft.

14. An apparatus according to claim 1, wherein the clamping portion comprises a covering for force-locking engagement with the optical lens, which covering consists of a material, which is softer than the material of the optical lens.

15. An apparatus according to claim 1, wherein the clamping portion comprises a covering for force-locking engagement with the optical lens, which covering consists of a leather material, which is softer than the material of the optical lens.

16. An apparatus according to claim 1, wherein the clamping portion comprises a covering for force-locking engagement with the optical lens, which covering consists of a synthetic leather material, which is softer than the material of the optical lens.

17. An apparatus according to claim 1, wherein the securing member and the securing member adapter each comprise rotary drive elements for form-fitting rotary drive of the securing member by the securing member adapter, and positioning elements for orientation with regard to angle of rotation of the securing member relative to the securing member adapter, wherein the positioning elements on the securing member optionally on the securing member adapter take the form of a plurality of asymmetrically arranged projections with end faces, the end faces of which asymmetrically arranged projections lie in a common plane perpendicular to the axis of rotation, while the positioning elements on the securing member adapter optionally on the securing member take the form of recesses associated in complementary manner with the asymmetrically arranged projections, said recesses starting from a flat surface perpendicular to the axis of rotation, and wherein an axial distance between the rotary drive elements and the positioning elements on the securing member is different from an axial distance between the rotary drive elements and the positioning elements on the securing member adapter, such that, if the securing member is moved axially towards the securing member adapter and rotation angle orientation has not yet been achieved, first of all the projections come to rest against the flat surface and then, once rotation angle orientation is complete, the projections enter into the recesses, whereupon the rotary drive elements come into engagement with one another.

18. An apparatus according to claim 17, wherein three of said projections are provided, with end faces that form the corners of a triangle.

19. An apparatus according to claim 17, wherein the projections have bezels starting respectively from their end faces.

20. An apparatus according to claim 17, wherein the recesses have bezels starting from the flat surface.

21. An apparatus according to claim 17, wherein the projections are formed on the securing member adapter, while the recesses are provided on the securing member.

22. An apparatus according to claim 17, wherein the securing member has a hub portion, on which the positioning elements are provided, and an annular portion which is connected resiliently with the hub portion and bears the rotary drive elements.

23. An apparatus according to claim 22, wherein the hub portion is connected preferably in one piece with the annular portion via a plurality of webs distributed evenly around the circumference.

24. An apparatus according to claim 17, wherein the rotary drive elements are formed on the securing member and on the securing member adapter by complementary annular toothing.

25. An apparatus for securing and clamping optical lenses requiring edge-machining, between first and second rotatable holding shafts, having a securing member, which may be attached detachably to one side of the optical lens, an adapter for the securing member, which may be connected rigidly to said first holding shaft and is constructed for rotation angle-oriented rotary drive of the securing member, and a clamping assembly, which comprises a fastening portion connectable rigidly to said second holding shaft and a clamping portion connected to the fastening portion, which clamping portion is constructed for force-locking engagement with a second other side of the optical lens, and wherein the securing member and the securing member adapter each comprise rotary drive elements for form-fitting rotary drive of the securing member by the securing member adapter, and positioning elements for orientation with regard to angle of rotation of the securing member relative to the securing member adapter, wherein the positioning elements on the securing member optionally on the securing member adapter take the form of a plurality of asymmetrically arranged projections with end faces, the end faces of which asymmetrically arranged projections lie in a common plane perpendicular to the axis of rotation, while the positioning elements on the securing member adapter optionally on the securing member take the form of recesses associated in complementary manner with the asymmetrically arranged projections, said recesses starting from a flat surface perpendicular to the axis of rotation, and wherein the axial distance between the rotary drive elements and the positioning elements on the securing member is different from an axial distance between the rotary drive elements and the positioning elements on the securing member adapter, such that, if the securing member is moved axially towards the securing member adapter and rotation angle orientation has not yet been achieved, first of all the projections come to rest against the flat surface and then, once rotation angle orientation is complete, the projections enter into the recesses, whereupon the rotary drive elements come into engagement with one another.

26. An apparatus according to claim 25, wherein three projections are provided, the end faces of which form the corners of a triangle.

27. An apparatus according to claim 25, wherein the projections and/or the recesses exhibit bezels starting respectively from the end faces of the former or the flat surface.

28. An apparatus according to claim 25, wherein the projections are formed on the securing member adapter, while the recesses are provided on the securing member.

29. An apparatus according to claim 25, wherein the securing member has a hub portion, on which the positioning elements are provided, and an annular portion which is connected resiliently with the hub portion and bears the rotary drive elements.

30. An apparatus according to claim 29, wherein the hub portion is connected preferably in one piece with the annular portion via a plurality of webs distributed evenly around the circumference.

31. An apparatus according to claim 25, wherein the rotary drive elements are formed on the securing member and on the securing member adapter by complementary annular toothing.

32. An apparatus according to claim 1, wherein the securing member is attachable to the optical lens by means of an adhesive film portion having first and second sides with adhesive on both of said first and second sides of the adhesive film portion, which exhibits greater adhesive power on said first side thereof, that faces the securing member than on said second side thereof that faces the optical lens.

33. An apparatus according to claim 32, wherein the adhesive film portion is provided with a tab, which is non-adhesive at least on said second side thereof that faces the optical lens.

34. An apparatus according to claim 32, wherein the adhesive film portion exhibits a thickness of between 0.025 and 0.2 mm.

* * * * *

UNITED STATES PATENT AND TRADEMARK OFFICE

CERTIFICATE OF CORRECTION

PATENT NO. : 6,641,466 B2 
DATED : November 4, 2003
INVENTOR(S) : Steffen Wallendorf and Holger Schafer It is certified that error appears in the above-identified patent and that said Letters Patent is hereby corrected as shown below:

Title page,
Item [73], Assignee, delete "Optikmaschinen AG" and insert -- Loh Optikmaschinen AG --

Signed and Sealed this

Twenty-second Day of June, 2004

JON W. DUDAS
*Acting Director of the United States Patent and Trademark Office*